United States Patent [19]

Vu

[11] 4,141,177

[45] Feb. 27, 1979

[54] REVERSIBLE, CREATIVE DOLLS AND METHOD OF ASSEMBLING SAME

[76] Inventor: Lisa A. Vu, 1469 Henry Ave., Des Plaines, Ill. 60016

[21] Appl. No.: 795,865

[22] Filed: May 11, 1977

[51] Int. Cl.[2] ..... A63H 3/02

[52] U.S. Cl. ..... 46/151; 46/153

[58] Field of Search ..... 46/17, 22, 151, 153

[56] References Cited

U.S. PATENT DOCUMENTS

| | | | |
|---|---|---|---|
| 1,615,401 | 1/1927 | Payne | 46/153 |
| 2,944,368 | 7/1960 | O'Brian et al. | 46/22 |
| 3,027,681 | 4/1962 | Hurst | 46/117 |
| 3,035,689 | 5/1962 | Arnheiter | 46/22 |
| 3,552,057 | 1/1971 | Antoinette | 46/151 |
| 3,783,553 | 1/1974 | Goozner | 46/151 |
| 3,918,196 | 10/1975 | Schleich | 46/151 |

*Primary Examiner*—Russell R. Kinsey
*Assistant Examiner*—Robert F. Cutting
*Attorney, Agent, or Firm*—Olson, Trexler, Wolters, Bushnell & Fosse, Ltd.

[57] ABSTRACT

A reversible doll is provided, which can be easily assembled by even inexperienced personnel from materials inexpensively offered in kit form. A fist doll head, which can be provided with oppositely directed faces, is installed upon a first stiffened chenille. To this first chenille, a second chenille is affixed, and spacers and relatively small fabric disks are alternately arrayed upon the second chenille extending in two directions away from the first chenille so as to form a first set of doll arms. Relatively large disks and spacers then can be installed below the doll arms upon the first chenille to form a first doll thorax. Below this thorax, a gown member can be installed to hide a lower, subsequently assembled second doll thorax, a second doll arm array and a second doll head. If desired, male figurines can be suggested by installing the gown immediately below the doll arms so as to cover the thorax regions and provide a tunic effect.

21 Claims, 6 Drawing Figures

REVERSIBLE, CREATIVE DOLLS AND METHOD OF ASSEMBLING SAME

BACKGROUND OF THE INVENTION

Reversible dolls of the "Raggedy Ann/Raggedy Andy" variety have found great favor with both children and adults for a number of years. Construction of such dolls has, however, been left primarily to commercial manufacturing enterprises, for assembling these dolls can be an intricate, tedious and difficult task.

The general object of the present invention is to provide a reversible doll which can be offered in a kit form and which can be constructed or assembled by even young, inexperienced or incapacitated persons. In broader terms, the construction opportunities offered by this doll kit are intended to satisfy a creative urge in anyone over the age of about 10 who has a heart to offer. The doll's transformability offers the doll's creator, or "master," multiple outlets for the heart and soul's diversity.

Another object is to provide such a doll which, when, assembled, has a posture memory, i.e., which has the ability to retain any of a wide range of postures into which the doll can be placed by its creator. For example, the doll can be made to stand by itself, to sit, or take other positions and retain them with but minimal or no outside support or assistance. More broadly, this posturing ability permits the doll to express the feelings and moods of the doll's creator.

Yet another object is to provide — in but a single doll — a number of personalities. More specifically, such a doll can provide all the personalities or characters in a given fairy story, nursery rhyme, or the like tale. In this way, the doll can act as an assistant in teaching those fables to small children, or to strangers from far-away lands. A correlative object is to provide such a doll which will have, in these ways, an extended interest value to young children, whose normal span of attention is relatively short.

Still another object is to offer such a doll which will withstand the energetically applied affections of young children and other doll fanciers.

A further object is to provide a doll kit and finished doll having the foregoing advantages, yet which can be offered at relatively modest cost.

Still further objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment and procedure, it will be understood that it is not intended to limit the invention to this embodiment. On the contrary, it is intended to cover all alternatives, modifications and equivalents as may be included within the spirit and scope of the invention as defined by the appended claims.

Figure 1:
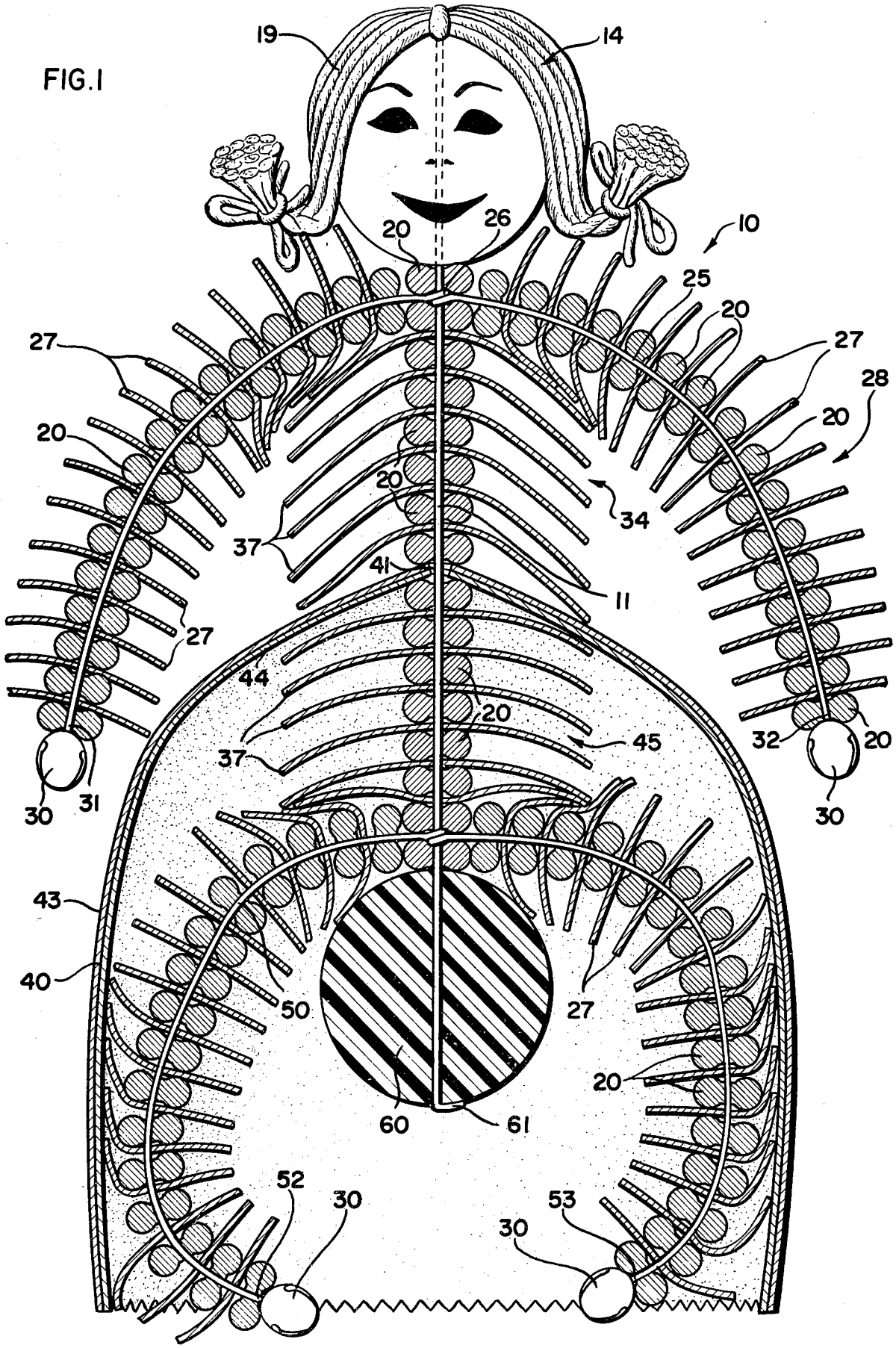
FIG. 1 is a sectional view showing the principal arrangement of a doll constructed in accordance with the present invention.
Figure 2:
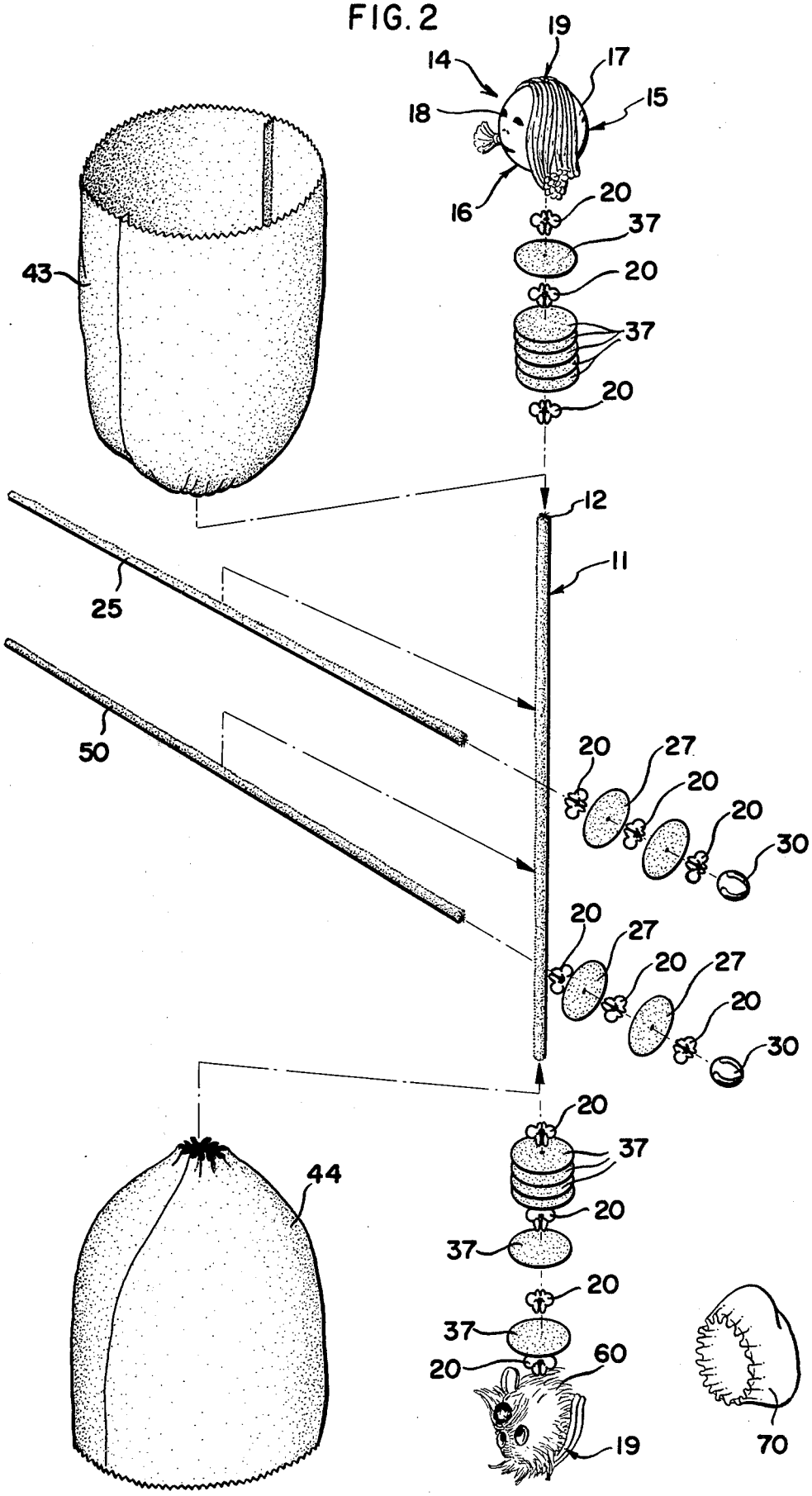
FIG. 2 is an exploded view of the doll shown in FIG. 1.
Figure 3:
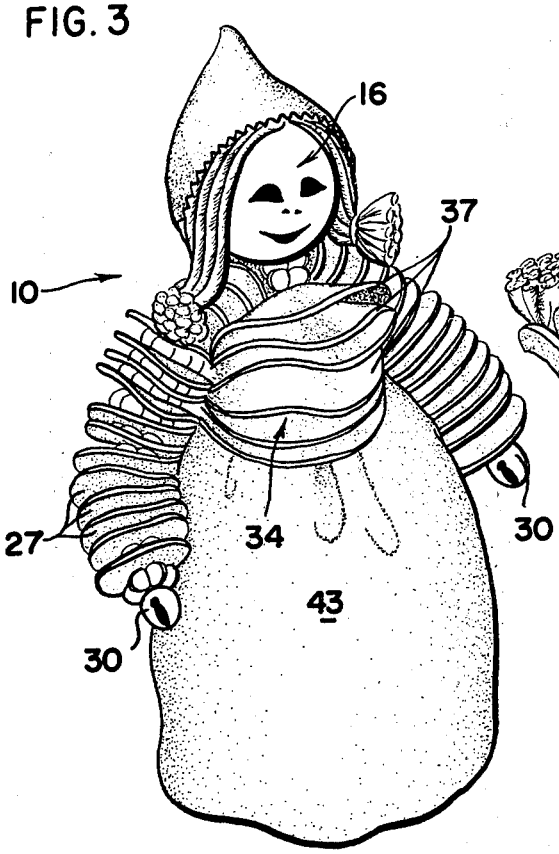
FIG. 3 is a perspective view showing the doll constructed in accordance with the present invention in one of its completed aspects.
Figure 4:
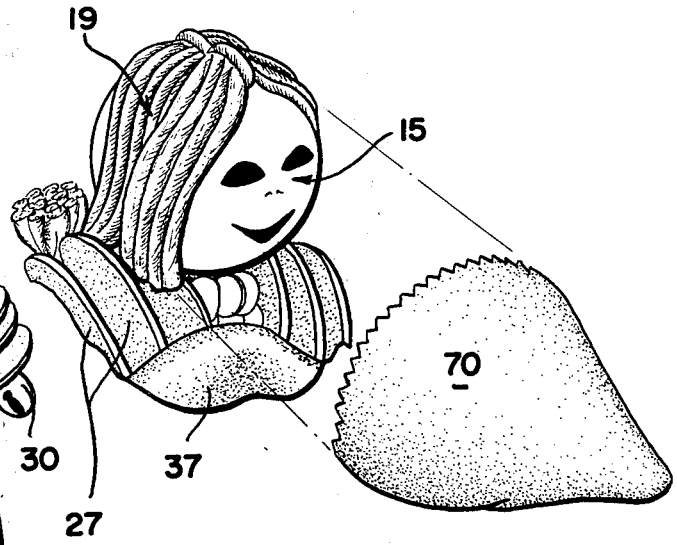
FIG. 4 is a fragmentary perspective view showing in further detail the head and relate portions of the doll.

Turning first to FIGS. 1–3, there is shown a doll 10 constructed in accordance with and having the features of the present invention. In accordance with one aspect of the invention, the doll 10 has postural memory: it can be retentively adjusted into a number of positions. To this end, the doll includes a first chenille member 11 which forms the backbone or longitudinal axis of the doll. This and the other chenille members used here preferably comprise twisted or braided multi-element wire, from which radially extend a quantity of fiber elements. The fiber element centers are woven or otherwise affixed between the wire strands so as to be held in place. In general appearance, these stiffened chenille members are not unlike very soft pipe cleaners of relatively great axial extent. When bent, a chenille member of this type will retain its given configuration. Thus, since the doll of the present invention uses these chenille members as spines, as arm structure supports, and in effect as hidden legs the doll is provided with postural memory.

Upon a first chenille end 12, a first doll head 14 is installed. To minimize manufacturing costs, and to provide an easily usable, yet creative doll head appearance, this doll head 14 can be offered as a simple sphere formed of styrofoam or like material. A diameter of $2\frac{1}{4}$ inches has been found to provide an attractive, manipulatable head size and yet offer economies of construction and manufacture.

It is a feature of the present invention that a relatively large number of doll characters can be offered in but one figurine. To this end, the doll head 14 can be provided with oppositely directed faces 15 and 16 carried upon oppositely directed doll head hemispheres 17 and 18. These faces can be formed by bonding or otherwise affixing suitably shaped eye, mouth and nose pieces upon the face hemispheres 17 and 18, or, alternatively, by drawing or otherwise indicating the facial features and appropriate expressions upon the head surfaces. Eyebrows, facial wrinkles, and the like can be indicated. To further enhance the visual distinction between the faces and face hemispheres 15 and 16, hair arrays or members 19 can be installed so as to overlap or divide the faces 15 and 16. This hair can be formed from yarn or other suitable materials.

After the head 14 has been installed upon the first chenille 16, a spacer member 20 is installed immediately below. The spacer elements 20 are here clear or colored translucent resinous plastic disks joined together at the disk edges so as to form the illustrated star-like general appearance, and can be on the order of $\frac{3}{4}''$ in diameter. A central hole permits the spacer to be pushed over the chenille member.

Below this first spacer member 20, a second chenille member 25 is secured to the first chenille 11 by wrapping or otherwise affixing the second chenille midpoint 26 to the first chenille member 11 at an appropriate point, as indicated in FIG. 1, thereby providing a cruciform chenille array. Extending outwardly from this second chenille member midpoint, an array of relatively small flexible disks 27, (described below) and spacer members 20 are installed. To encourage secure construction, yet offer easy doll part movement and good posture memory, this spacer-and-disk array 28 and 29 commences adjacent the first chenille member with spacers 20, and terminates, as well, in spacers 20 at the distal ends of the second chenille member 25. Doll attractiveness can be enhanced by bell members 30 affixed to each end 31 and 32 of the second chenille member 25.

To form an upper torso or thorax portion 34 of the doll, relatively large disks 37 are installed in alternate array with additional spacer members 20 along the first chenille member 11. These disk members 27 and 37, both large and small, can be inexpensively yet attractively formed of felt or similar cloth material cut into disks on the order of 1½ inches and 2½ inches in diameter. Central disk holes can be formed to enhance easy doll assembly.

To hide the additional doll configurations, a long skirt or gown member 40 is installed upon the first chenille member 11. If a female figurine is desired, this gown member 40 can be installed at a first chenille midpoint 41. If the male figurine is desired, a tunic effect can be provided by installing the gown member just below the second chenille member 25. Here, the gown member 40 is provided with two oppositely directed faces by making the gown 40 of nesting felt or other fabrics 43 and 44. Concealment of some figurines is offered by extending the gown along it axial length, relative to the first chenille member, so as to hide other doll heads and arm structure. When inverted, the concealed head and arm structure and the relative stiffness of the felt gown 40 helps in permitting the doll 10 to be placed in a standing or other posture and to retain that posture with relatively good memory.

To form a second thorax 45 for the doll, additional relatively large disk members 37 and spacers 20 are assembled on the first chenille 11. The second thorax construction is halted at a point on the chenille 11 which permits subsequent attachment of additional arms and a head. The thorax 45 axial length can be conveniently limited by limiting the number of large disks 37 included in the assembly kit.

As indicated in FIG. 1, a second set of arms is provided by a third chenille 50 affixed, at a third chenille midpoint, 51 to the first chenille 11. Again, relatively small flexible disks 27 are alternatively arrayed with spacer members 20 to form the arms. Again, too, bell members 30 can be affixed to the distal ends 52 and 53 of the third chenille member 50. As above, spacer members 20 can be located immediately adjacent the third chenille midpoint 51, and the arm arrays can both begin and end with spacer members 20, as illustrated.

Below the third chenille 50 is affixed a second head member 60. In a manner similar to the affixation process used for the first head member 14, the second head 60 can be attached to the first chenille 11 by forcing the first chenille entirely through the head member 60. A small end tab 61 can be then bent so as to secure the second head member 60 upon the chenille 11.

Figure 5:
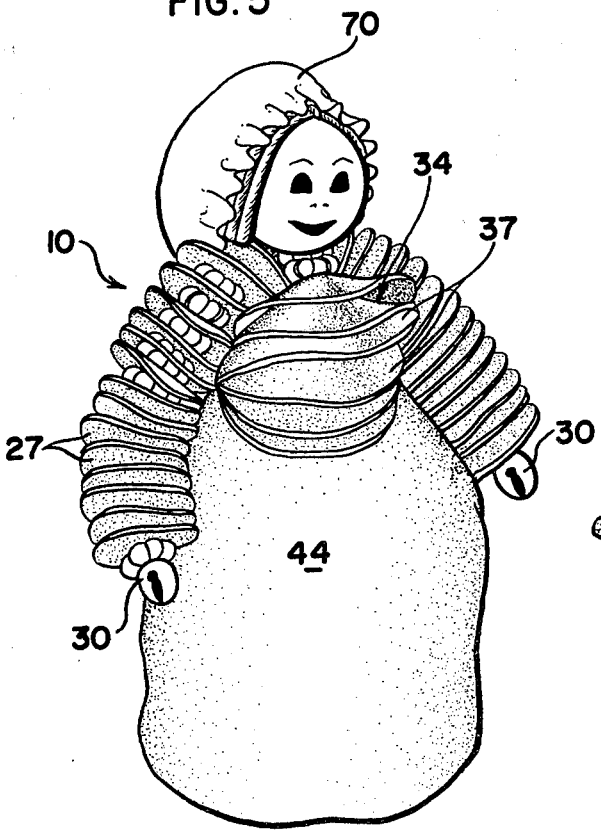
FIG. 5 is a perspective view similar to FIG. 3 and showing the doll in another of its finished aspects.
Figure 6:
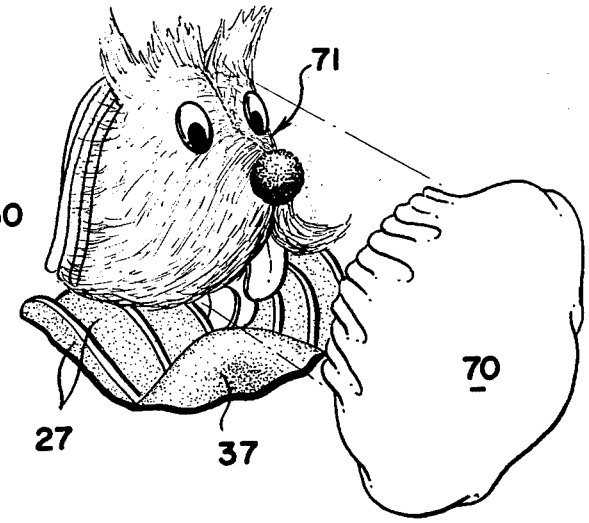
FIG. 6 is a fragmentary perspective view similar to FIG. 4 and showing yet another head and related portion of the doll.

In carrying out the invention, the doll 10 can be used by a narrator to illustrate a fairy story or nursery tale such as the story of Little Red Riding Hood or the like. To this end, the various personality configurations or story characters can be provided on and in the same doll. By removing the cap 70, and then turning the doll about, another face 15 can be offered, and that face can have a marked difference in appearance from the originally offered face 16. For example, a grandmother-like appearance can be offered, as illustrated in FIG. 5. When grandmother's cap 70 is removed, a wolf face 71 can be made to appear with surprising suddeness, to the delight of an audience of children.

Alternatively, a full hood cap, covering the entire head, can be pulled over the head to cover both face representations. An additional face can be indicated on the head outside to suggest yet additional figurines. Accessories, such as a small picnic basket or the like (not shown) can also be provided to complete the doll's appearance.

From the foregoing description, it will be understood that the construction elements and other materials required to make a doll of this type can be provided in kit form at a commercially attractive price, in furtherance of the invention. For example, such a kit can include two head spheres, three chenille members (each about 12 inches in length), on the order of eighty spacer members, and an appropriate number of large and small disk elements. Individual figurine construction can be designated by appropriately selecting the colors for these felt disk elements and for the spacer elements. Four arm-end bells, and sufficient felt or other material to complete the gowns can also be included in the kit. An accompanying instruction sheet or manual can suggest, in whatever detail desired, specific sewing instructions for the creation of various specific doll appearances, and can also teach the above-described method of doll construction. In accordance with another aspect of the invention, even inexperienced, incapacitated or young people can complete assembly of the doll from a kit such as that described here with surprising ease, and in a short period of time. For example, after the doll garments have been sewn together and otherwise preliminarily prepared, final doll assembly can be completed in little more than twenty minutes.

The invention is claimed as follows:

1. A method of assembling a doll, comprising the steps of passing a first bi-ended stiffened chenille into a first head member, affixing a second stiffened chenille to the first chenille at a point on the first chenille below the first head member and substantially at the second chenille midpoint to provide a cruciform chenille array, alternately installing inflexible spacer members and small flexible disk members upon the second chenille so as to form first doll arms, installing at least one gown member on the first chenille so as to cover at least portions of subsequently formed doll arms and a subsequently installed doll head member, alternately installing inflexible spacer members and flexible disk members upon the first chenille only between the second chenille and a first chenille midpoint so as to form a first doll thorax, installing a gown skirt member substantially at the first chenille midpoint below the first thorax, and thereafter alternately installing inflexible spacer members and flexible disk members upon the first chenille so as to form a second doll thorax, affixing a third stiffened chenille to the first chenille at a point on the first chenille member below the first doll arms and substantially at the third chenille midpoint, alternately installing inflexible spacer members and small flexible disk members upon the third chenille so as to form second doll arms, and passing the second end of the first chenille into a second head member so as to provide a second doll head thereby forming a reversible doll having two exposable thorax portions.

2. A method of making a doll according to claim 1 including the step of passing at least one chenille end entirely through a doll head member so as to securely affix the doll head member upon the chenille.

3. A method of making a doll according to claim 1 wherein the step of alternatively installing said spacer members and small flexible disk members upon a second or third chenille so as to form doll arm is begun and ended by installing a spacer member upon said chenille.

4. A method of making a doll according to claim 3 including the step of affixing bell members at each end of the second or third chenilles to form attractive doll arm distal ends.

5. A method of making a doll according to claim 1 including the step of representing a face on opposite hemispheric sides of at least one doll head member, and installing a cap member in a covering position over at least one of the represented faces.

6. A method of making a doll according to claim 5 including the step of affixing a cap hood member over both faces and the entire head member, and indicating a face representation on at least one outer side of the cap head member.

7. A method of making a doll according to claim 5 including the step of attaching hair-representing members to a head member between the represented faces, to heighten the visual distinction between the oppositely directed faces.

8. A method of making a doll according to claim 1 including the step of installing spacer members immediately adjacent each gown member installed upon the first chenille.

9. A multi-figure doll, comprising a first head member, at least one face representation carried upon one side of the head member, a first bi-ended, stiffened chenille passing at least partly into the first head member, a second stiffened chenille affixed to the first chenille at point below the first head member on the first chenille and substantially at the second chenille midpoint, a plurality of spacer members and flexible disk members installed in alternating array upon the second chenille and extending away from the first chenille and in two directions to form a first set of dolls arms, a gown member installed at a mediate point upon the first chenille below the second chenille, the gown extending along the first chenille length sufficiently to cover remaining portions of the chenille, a third stiffened chenille affixed to the first chenille member at a point mediate the first chenille ends and substantially at the midpoint of the third chenille, an array of relatively small flexible disk members and spacer members installed in alternating array upon the third chenille and extending away from the first chenille in two directions to form a second set of doll arms, a second head member installed upon the second end of the first chenille member, a plurality of large flexible disk members and spacer members installed in alternating array between the second chenille and third chenille along the first chenille, said gown member being installed at substantially the axial midpoint of said first chenille, said gown member being reversible and being provided with oppositely directed, finished sides of a length sufficient to provide said doll with oppositely oriented but exposed thorax regions between the gown/chenille installation point and each doll head.

10. A doll according to claim 9 wherein said first chenille passes completely through each doll head member.

11. A doll according to claim 9 including a spacer member installed upon said first chenille immediately adjacent each said head member.

12. A doll according to claim 9 wherein at least one spacer member is installed upon said first chenille immediately adjacent said second chenille and immediately adjacent said third chenille.

13. A doll according to claim 9 wherein a spacer member is installed upon opposite sides of said first chenille upon said second chenille and upon said third chenille, and wherein a spacer member is installed at each outer end of each of said second and third chenilles.

14. A doll according to claim 13 including bell members installed upon the distal ends of each of said second and third chenilles.

15. A doll according to claim 9 including oppositely directed face representations upon opposite hemispheres of at least one doll head member.

16. A doll according to claim 15 including a cap member adapted to be installed in a covering position over at least one of said two doll head faces.

17. A doll according to claim 16 wherein said cap comprises a cap hood member adapted to be installed entirely over one of said doll heads, and a face representation carried upon an outer side of at least one side of said cap hood member.

18. A doll according to claim 15 including hair-representing members affixed to at least one head member between the oppositely directed faces to heighten the visual distinction between the oppositely directed faces.

19. A kit for constructing multi-figure dolls, the kit comprising at least two head members, a first bi-ended stiffened chenille capable of being passed at least partly into each head member, a second stiffened chenille capable of being affixed to the first chenille at a point below the first head member on the first chenille and substantially at the second chenille midpoint, a plurality of spacer members and a like plurality of small flexible disk members for installation in alternating array upon the second chenille and extending away from the first chenille and in both directions to form a first set of doll arms, a gown member for installation at a mediate point upon the first chenille below the second chenille, the gown having a length sufficient to extend along the first chenille length and thereby cover remaining portions of the chenille, a third stiffened chenille member capable of being affixed to the first chenille member at a point mediate the first chenille member ends and substantially at the midpoint of the third chenille, and another plurality of relatively small flexible disk members and a like plurality of inflexible spacer members for installation upon the third chenille in alternate array so as to form a second set of doll arms.

20. A kit according to claim 19 including a plurality of large flexible disk members and a like plurality of spacer members capable of being installed in alternating array between the second and third chenilles along the first chenille to form two doll thoraxes.

21. A kit according to claim 19 including at least four bell members for attachment to the doll arm distal ends.

* * * * *